US006402563B1

(12) United States Patent
Shi et al.

(10) Patent No.: US 6,402,563 B1
(45) Date of Patent: Jun. 11, 2002

(54) CABLE CONNECTOR ASSEMBLY

(75) Inventors: GuangXing Shi; Zuoxi Tan; Suiya Wang, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,039

(22) Filed: Jun. 26, 2001

(30) Foreign Application Priority Data

Dec. 30, 2000 (TW) ..... 89222907

(51) Int. Cl.[7] ..... H01R 24/06
(52) U.S. Cl. ..... 439/676
(58) Field of Search ..... 439/676, 701, 439/540.1, 607–610

(56) References Cited

U.S. PATENT DOCUMENTS 4,030,804 A * 6/1977 Enomoto
5,624,274 A * 4/1997 Lin ..... 439/417
5,688,145 A * 11/1997 Liu ..... 439/607
5,885,111 A * 3/1999 Yu ..... 439/676
5,980,320 A * 11/1999 Slack et al. ..... 439/676
6,053,770 A * 4/2000 Blom ..... 439/497
6,157,542 A * 12/2000 Wu ..... 439/676
6,203,379 B1 * 3/2001 Cai et al. ..... 439/676
6,206,725 B1 * 3/2001 Wu ..... 439/676
6,217,371 B1 * 4/2001 Wu ..... 439/676

* cited by examiner

*Primary Examiner*—Gary F. Paumen
(74) *Attorney, Agent, or Firm*—Wei Te Chung

(57) ABSTRACT

A cable connector assembly (1) comprises an electrical connector, a wire-securing element (20) and a cable (30). The connector has an insulative housing (11) and a plurality of electrical contacts (130) secured therein. Each contact has an elastic engaging portion (132). The wire-securing element has a base (21) and a plurality of receiving grooves (22) defined in a front portion of the base. Wires (31) of the cable are pressed and embedded in the receiving grooves of the wire-securing element by the engaging portions of the contacts. Thus, reliable and durable electrical connection between the connector and the cable is attained.

1 Claim, 7 Drawing Sheets

CABLE CONNECTOR ASSEMBLY

BACKGROUND OF THE INVENTION

1. Field of the Invention

The present invention relates to connection of cables in electrical connectors, and more particularly to modular jack assemblies. which can readily and securely terminate wires of a cable.

2. Description of the Related Art

A cable is commonly used between different electrical devices for connecting the devices and transmitting electrical signals therebetween. Typically, an electrical connector must secure an end portion of a cable such that a multiplicity of wires of the cable electrically connects with corresponding terminals of the connector. A conventional cable connector assembly is thereby made, for mating with electrical devices and providing electrical signal transmission.

Connection of wires of a cable with terminals of a connector can be attained in several ways. One way is to solder the terminals of the connector directly to the respective wires of the cable. Solder used in this process is an alloy typically comprising about 60% tin and 40% lead. When such alloy is heated and melted, it can be detrimental to an operator's health and pollute the surrounding environment. Furthermore, soldering the cable to the connector is laborious and time-consuming.

Another way of connecting a cable to a connector is to terminate the terminals of the connector into the wires of the cable by insulation displacement connection (IDC) technology. Examples of this are disclosed in U.S. Pat. Nos. 5,624,274, 5,688,145 and 5,885,111. IDC technology requires that the terminals and the wires be very accurately aligned with each other. Otherwise, the terminals of the connector cannot accurately and correctly puncture and terminate the corresponding wires of the cable. In such case, the electrical connection will be less reliable and durable. In addition, IDC is prone to the risk of uneven insertion force being applied during insertion of the terminals of the connector into the wires of the cable. This can also result in inferior electrical connection or even failure of connection.

Still another way of connecting a cable to a connector is to use a printed circuit board (PCB) which connects the cable and the connector. An example of this is disclosed in U.S. Pat. No. 6,053,770. The terminals of the connector and the wires of the cable have to be separately soldered to the PCB. This is very time-consuming and increases the overall size of the cable connector assembly. Moreover, having to include a PCB further adds to costs. Yet another way of connecting a cable to a connector is disclosed in U.S. Pat. No. 4,030,804, wherein riveting elements are used to connect the connector and the cable. But the required riveting elements add to costs, and assembling the riveting elements with the connector and the cable is complicated and time-consuming.

In view of the above, a new type of cable connector assembly is desired, wherein improved connection between a cable and a connector is achieved.

SUMMARY OF THE INVENTION

An object of the present invention is to provide a cable connector assembly wherein a plurality of electrical contacts of a connector and a plurality of wires of a cable can attain reliable and durable electrical connection without soldering or riveting or unduly high accuracy being required during assembly.

Another object of the present invention is to provide a cable connector assembly having a wire-securing element in an insulative housing thereof, such that reliable and durable electrical connection between a connector and a cable can be attained without increasing the size of the whole assembly.

A further object of the present invention is to provide a cable connector assembly for connecting electrical contacts of a connector to wires of a cable in a convenient and cost-efficient manner.

To fulfill the above objects, a cable connector assembly in accordance with the present invention comprises an electrical connector, a wire-securing element and a cable. The connector comprises an insulative housing and a plurality of electrical contacts secured therein. Each contact has a contact portion at a front end, an elastic engaging portion at a rear end, and a connecting portion between the contact portion and the engaging portion. The wire-securing element has a base and a plurality of receiving grooves defined in a front portion of the base. Wires of the cable are pressed and embedded in the receiving grooves of the wire-securing element by the engaging portions of the contacts. Thus, reliable and durable electrical connection between the connector and the cable is attained.

DESCRIPTION OF THE PREFERRED EMBODIMENTS

Figure 1:
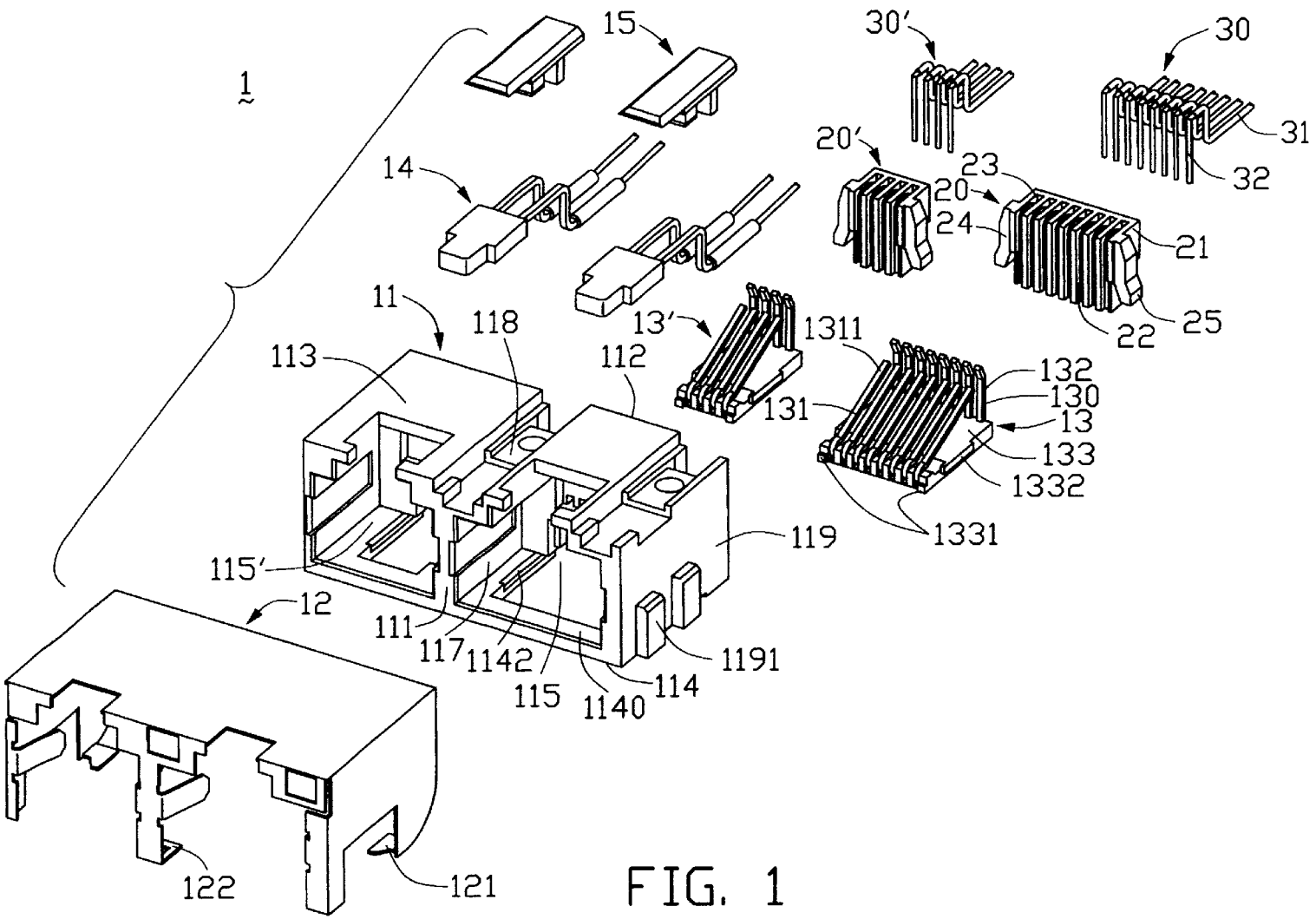
FIG. 1 is an exploded view of a cable connector assembly in accordance with a preferred embodiment of the present invention.

Referring to FIG. 1, a cable connector assembly 1 in accordance with a preferred embodiment of the present invention includes a connector, a first wire-securing element 20 and a cable 30. In the preferred embodiment, the connector is a combination of an RJ-11 modular jack and an RJ-45 modular jack. Such connector comprises an insulative housing 11, a metallic shield 12, a first terminal module 13, a second terminal module 13', two LED devices 14 and two locating slabs 15.

Figure 2:
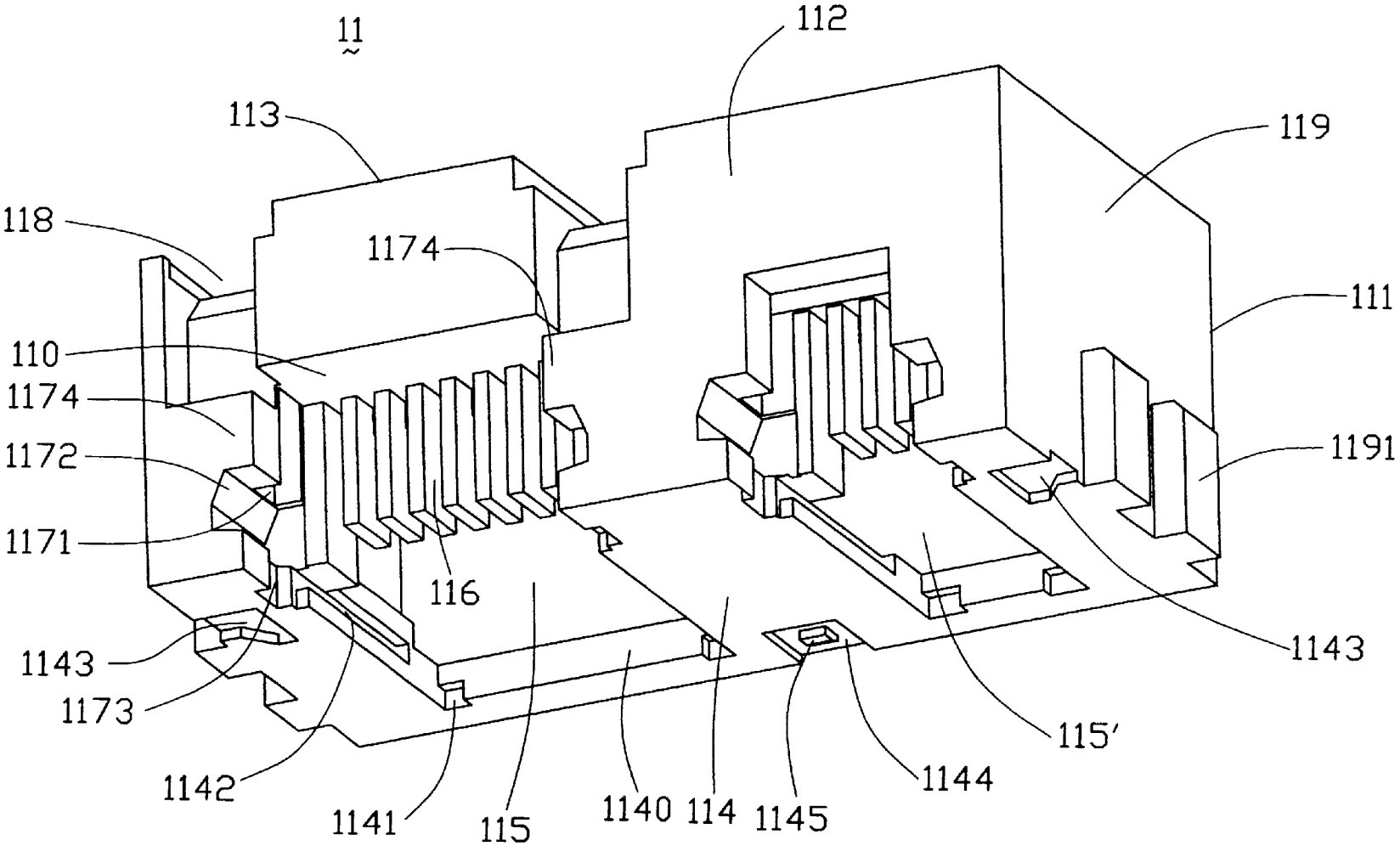
FIG. 2 is a perspective view of an insulative housing of a connector of the cable connector assembly of FIG. 1, but viewed from a rear aspect.
Figure 3:
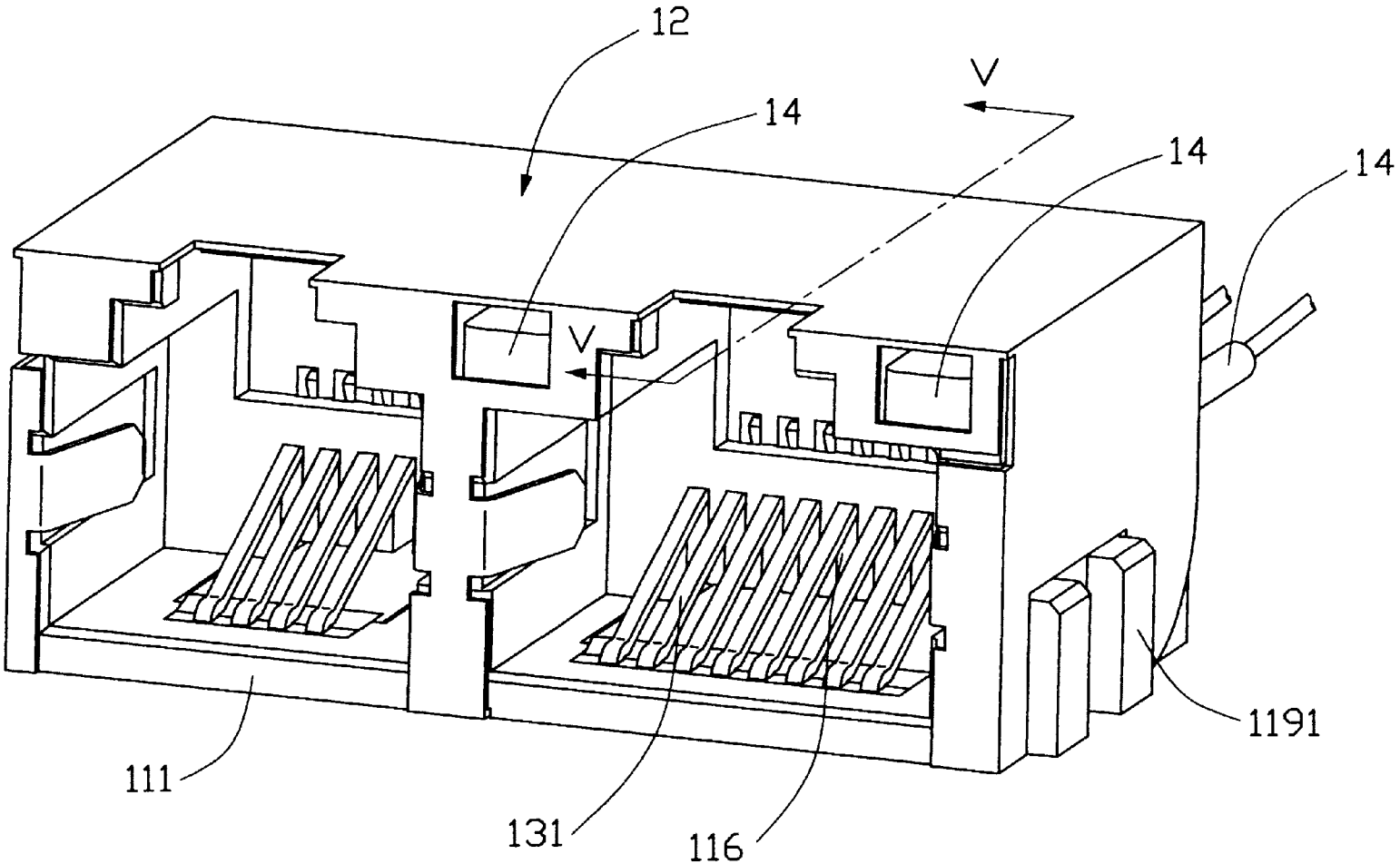
FIG. 3 is an assembled view of FIG. 1.

Referring particularly to FIGS. 2 and 3, the housing 11 of the connector has a front wall 111, a back wall 112, a top wall 113, a bottom wall 114, two external side walls 119, a dividing wall 117, a first receiving space 115 and a second receiving space 115'. The first receiving and second receiving spaces 115, 115' extend through the front wall 111 and the back wall 112, for receiving corresponding RJ-45 and RJ-11 modular plugs respectively. The housing 11 essentially comprise two portions which respectively define the first and the second receiving spaces 115, 115' therein. These two portions have essentially the same structure, except that they differ in width. Therefore, in general, only the portion which defines the first receiving space 115 will be described in detail herein.

A plurality of slots 116 is defined in the housing 11 at a rear of the first receiving space 115, corresponding to the first terminal module 13. A receiving opening 110 is defined at a rear of and in communication with the slots 116, for accommodating the first wire-securing element 20. A rectangular stop bar 1140 is formed at a front, lower end of the housing 11 and below the first receiving space 115. A pair of notches 1141 is defined in lower portions of opposite ends of the stop bar 1140 respectively. A pair of grooves 1142 is defined in the housing 11 generally at opposite sides of a lower extremity of the first receiving space 115. Each groove 1142 extends from the back wall 112 to a point near to but rearward of the stop bar 1140. A pair of vertical rectangular recesses 1171 is respectively defined in the side wall 112 and the dividing wall 117. Each recess 1171 is in communication with the receiving opening 110, and the recesses 1171 oppose each other across the receiving opening 110. Two locking tabs 1174 are thereby formed in the back wall 112 adjacent rear extremities of the vertical recesses 1171 respectively. A polygonal cutout 1172 is defined below and in communication with each vertical recess 1171. A depression 1173 is defined through the bottom wall 114 at a rear of and communication with each groove 1142, and below the corresponding cutout 1172. Two channels 118 are defined in the top wall 113 from the front wall 111 through to the back wall 112, for accommodating the LED devices 14 therein. Two polygonal recesses 1143 are defined in the bottom wall 114, at junctions between the bottom wall 114 and the external side walls 119 respectively. A rectangular recess 1144 is defined in a central portion of the bottom wall 114 at a junction between the bottom wall 114 and the front wall 111. A catch 1145 is formed in the bottom wall 114, projecting down into the rectangular recess 1144. A pair of vertical ribs 1191 is formed on each external side wall 119, for securing the cable connector assembly 1 to other electrical devices.

Figure 4:
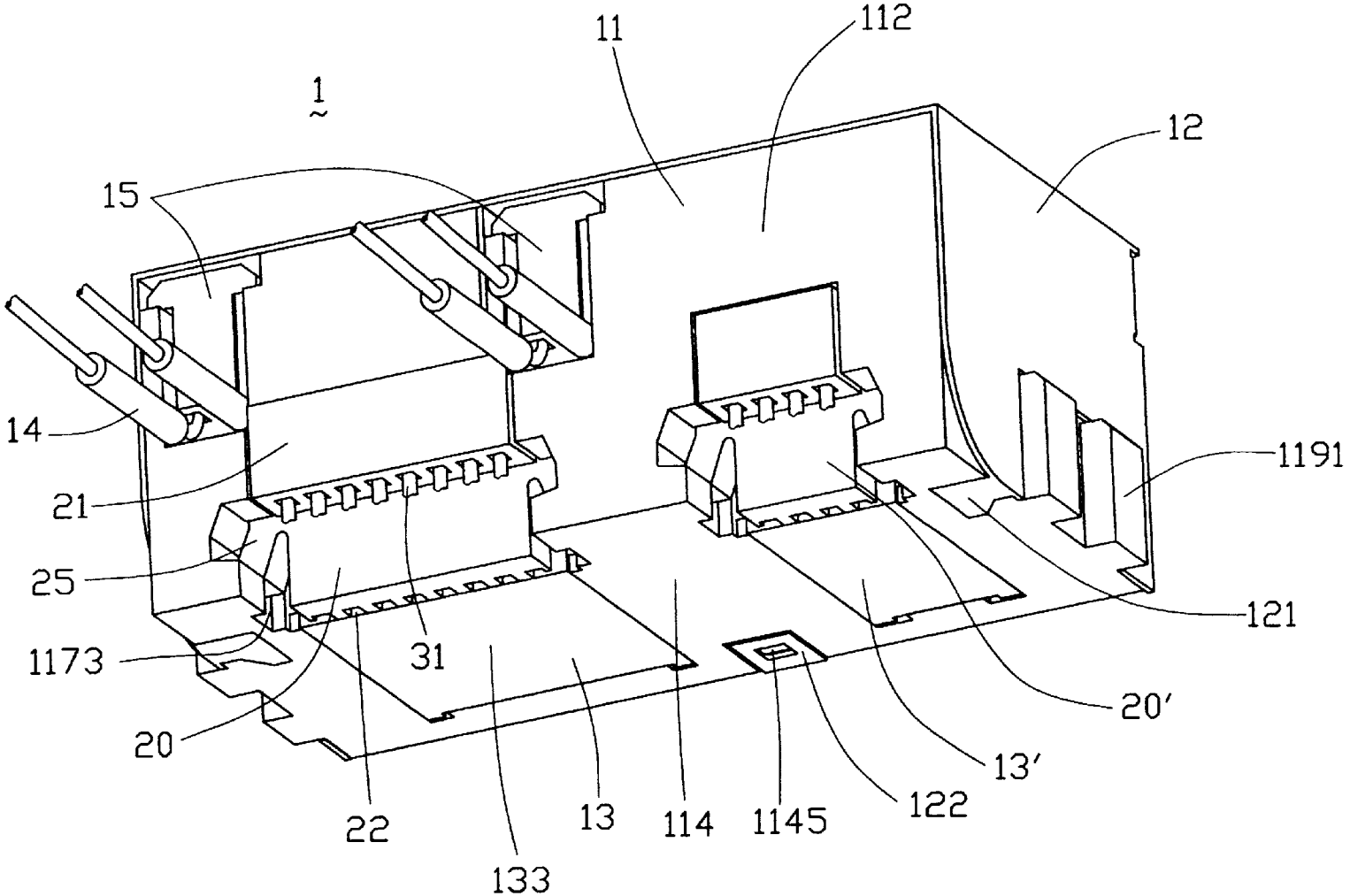
FIG. 4 is similar to FIG. 3, but viewed from a rear aspect.

Referring to FIGS. 1 and 4, the shield 12 is formed from a metal sheet. Two first fastening projections 121 extend inwardly from opposite sides of the shield 12 respectively, for engaging in the polygonal recesses 1143 of the housing 11. A second fastening projection 122 extends inwardly from a middle portion of the shield 12, for engaging in the rectangular recess 1144 of the housing 11. A rectangular hole (not labeled) is defined in the second fastening projection 122, for engagingly receiving the catch 1145 of the housing 11.

The first and second terminal modules 13, 13' have substantially the same structure, except that they have different numbers of contacts. The first and second terminal modules 13, 13' correspond to the first and second receiving spaces 115, 115' respectively. Therefore only the first terminal module 13 will be described in detail herein. The first terminal module 13 comprises a base board 133, and a plurality of contacts 130 insert molded therein. The base board 133 is made of an insulatve material such as plastic. Each contact 130 includes a contact portion 131, a connecting portion 134 secured into the base board 133, and an elastic engaging portion 132. The contact portion 131 extends rearwardly and upwardly from a front end of the connecting portion 134, at an acute angle therefrom. The elastic engaging portion 132 extends substantially vertically upwardly from a rear end of the connecting portion 134. Each contact portion 131 has a terminal 1311 at a distal end thereof. A pair of lugs 1331 extends forwardly from opposite extremities of a front portion of the base board 133, for engaging in the notches 1141 of the housing 11. A pair of engaging bars 1332 is formed on opposite sides of the base board 133 respectively, for engaging in the grooves 1142 of the housing 11.

Referring to FIGS. 1, 2 and 4, the first and second wire-securing elements 20, 20' have substantially the same structure, except that they differ in size. Therefore only the first wire-securing element 20 will be described in detail herein. The first wire-securing element 20 has a terraced base 21, a plurality of vertical receiving grooves 22, and a plurality of vertical through holes 23. The receiving grooves 22 are defined in a front portion of the base 21, for receiving the engaging portions 132 of the first terminal module 13. The through holes 23 are defined in a rear portion of the base 21, and are respectively in communication with rear extremities of the receiving grooves 22. A pair of arms 24 extends from opposite sides of the base 21 respectively, for engaging in the vertical recesses 1171 of the housing 11. A latching end 25 is outwardly and downwardly formed at a bottom portion of each arm 24, for engaging in the corresponding cutout 1172 of the housing 11.

The cable 30 comprises a plurality of wires 31. Each wire 31 has an internal conductor 32. A cable 30' is substantially the same as the cable 30, except that the cable 30' is smaller and has fewer wires and conductors.

In assembly, the first and second terminal modules 13, 13' are inserted into the housing 11 from outside the back wall 112 of the housing 11. The contact portions 131 of the contacts 130 of the first terminal module 13 are received into the first receiving space 115 of the housing 11. The terminals 1311 of the contacts 13 are engaged in the slots 116, and the engaging portions 132 of the contacts 130 are exposed in the receiving opening 110 of the housing 11. At the same time, the base board 133 of the first terminal module 13 abuts the rectangular stop bar 1140 of the housing 11. The lugs 1331 and the engaging bar 1332 of the first terminal module 13 are respectively fittingly engaged in the notches 1141 and the grooves 1142 of the housing 11. The LED devices 14 are then inserted into the channels 118 of the housing 11. The locating slabs 15 are inserted into the channels 118 to locate the LED devices 14 therein. Then the shield 12 is attached to the housing 11, with the first and second fastening projections 121, 122 of the shield 12 respectively engaging in the first and second polygonal recesses 1143, 1144 of the housing 11. The shield 12 thereby encloses the housing 11, the LED devices 14 and the locating slabs 15 therein.

The cables 30, 30' are then pre-assembled into the first and second wire-securing elements 20, 20' respectively. Sheaths of the wires 31 of the cable 30 are removed to expose the conductors 32 therein. The conductors 32 are inserted into the through holes 23 of the first wire-securing element 20 from a lower end thereof, such that the conductors 32 protrude out beyond upper ends of the through holes 23. The pre-assembled first and second wire-securing elements 20, 20' are then pressed upwardly into the housing 11 from outside the bottom wall 114 of the housing 11. The arms 24 of the first wire-securing element 20 are initially received in and guided along the depressions 1173 of the housing 11. The arms 24 engage in the vertical recesses 1171 of the housing 11, and are locked therein by the locking tabs 1174 of the housing 11. The latching ends 25 of the first wire-securing element 20 engage in the polygonal cutouts 1172 of the housing 11.

Figure 5:
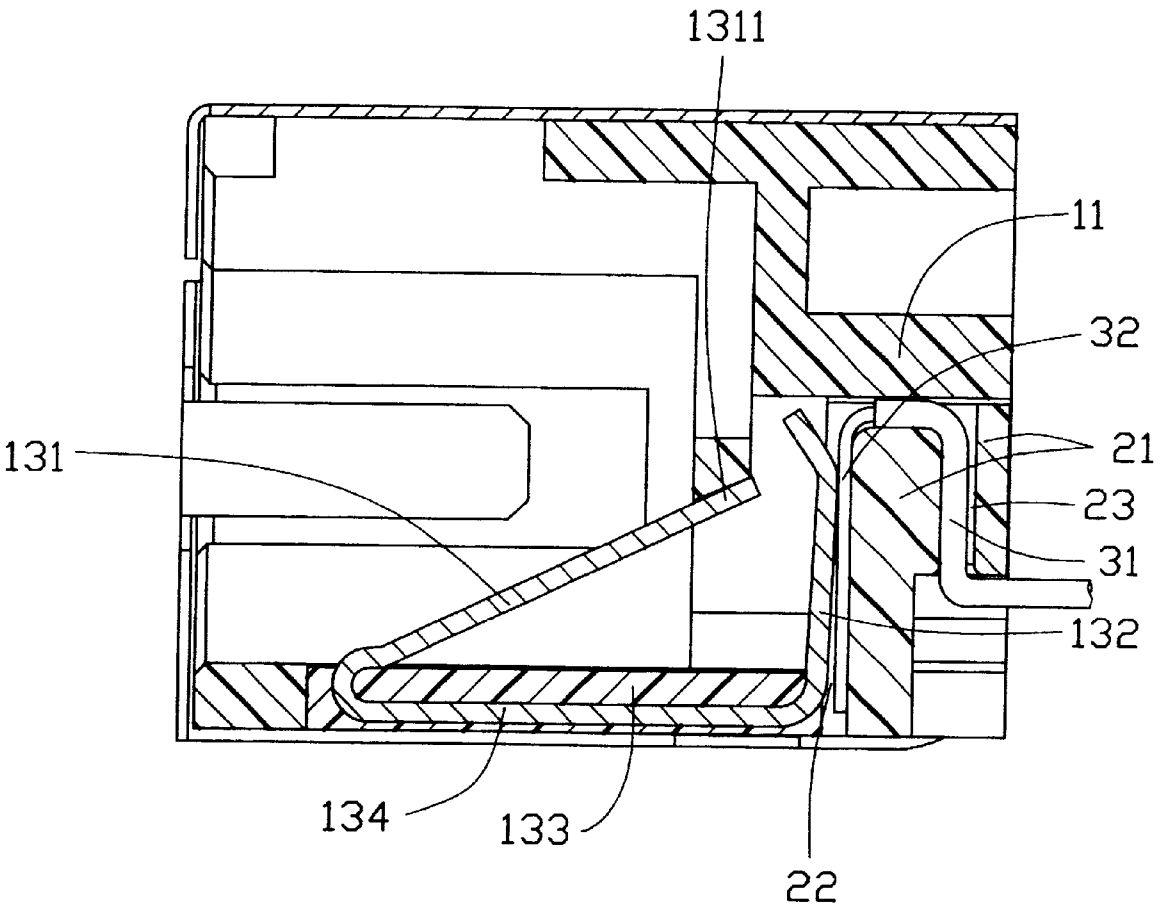
FIG. 5 is a cross-sectional view taken along line V—V of FIG. 3.

Referring to FIG. 5, it can be seen that an end portion of each wire 31 is sandwiched in the receiving opening 110 of the housing 11 between the terraced base 21 of the wire-securing element 20 and the housing 11 itself. The conductors 32 of the wires 30 are firmly and precisely held in position by the engaging portions 132 of the contacts 130. Because the connecting portions 134 of the contacts 130 are secured in the base board 133 of the first terminal module 13, the engaging portions 132 of the contacts 130 elastically distort when the first wire securing element 20 is engaged in the housing 11. Each engaging portion 132 thereby exerts a strong pressing force against the corresponding conductor 32. Such pressing force firmly embeds the conductors 32 in the receiving grooves 22 of the first wire-securing element 20. Thus secure and lasting electrical connection is attained between the connector and the cable 30.

Figure 6:
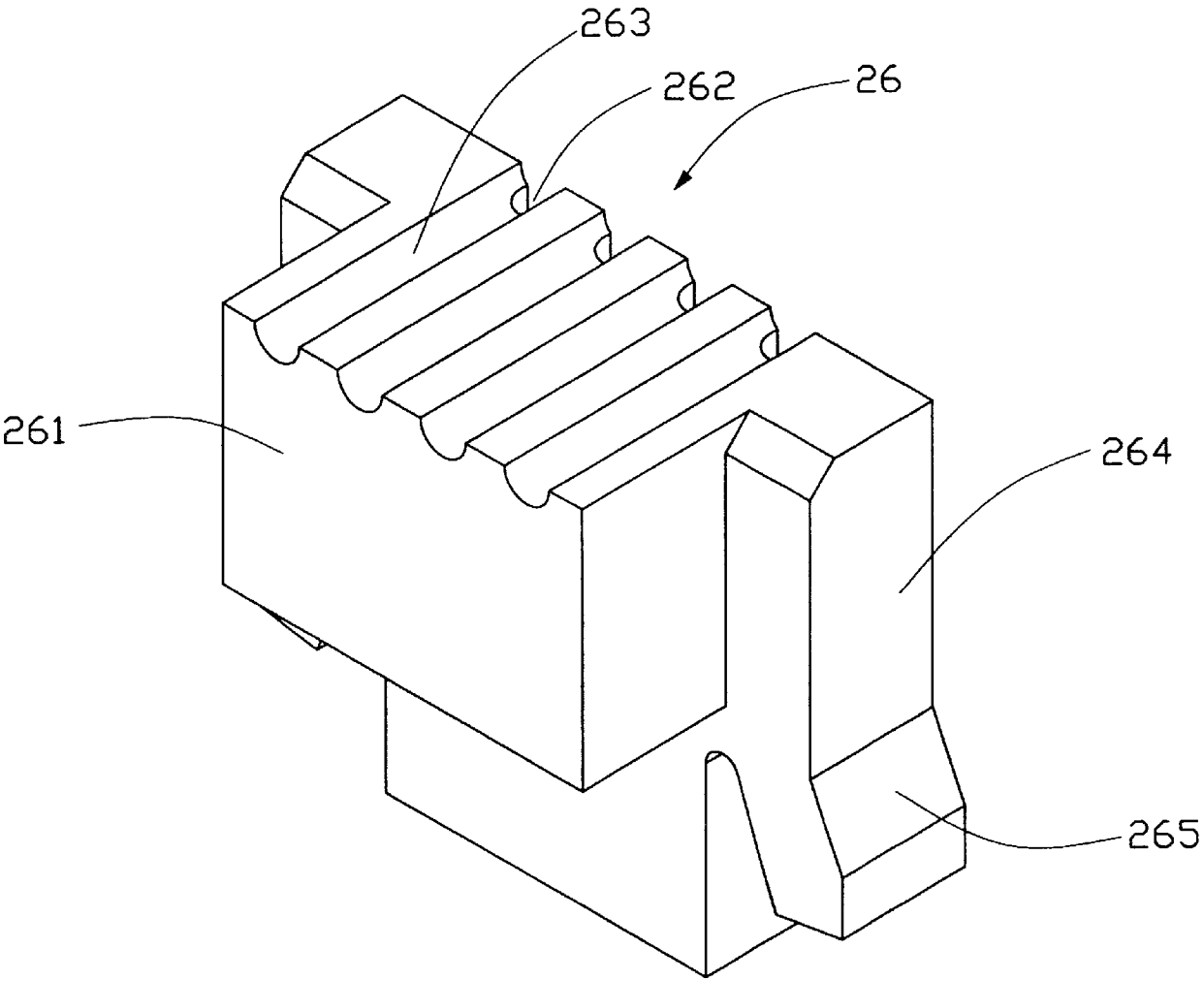
FIG. 6 is a rear aspect perspective view of a wire-securing element for a cable connector assembly in accordance with an alternative embodiment of the present invention.
Figure 7:
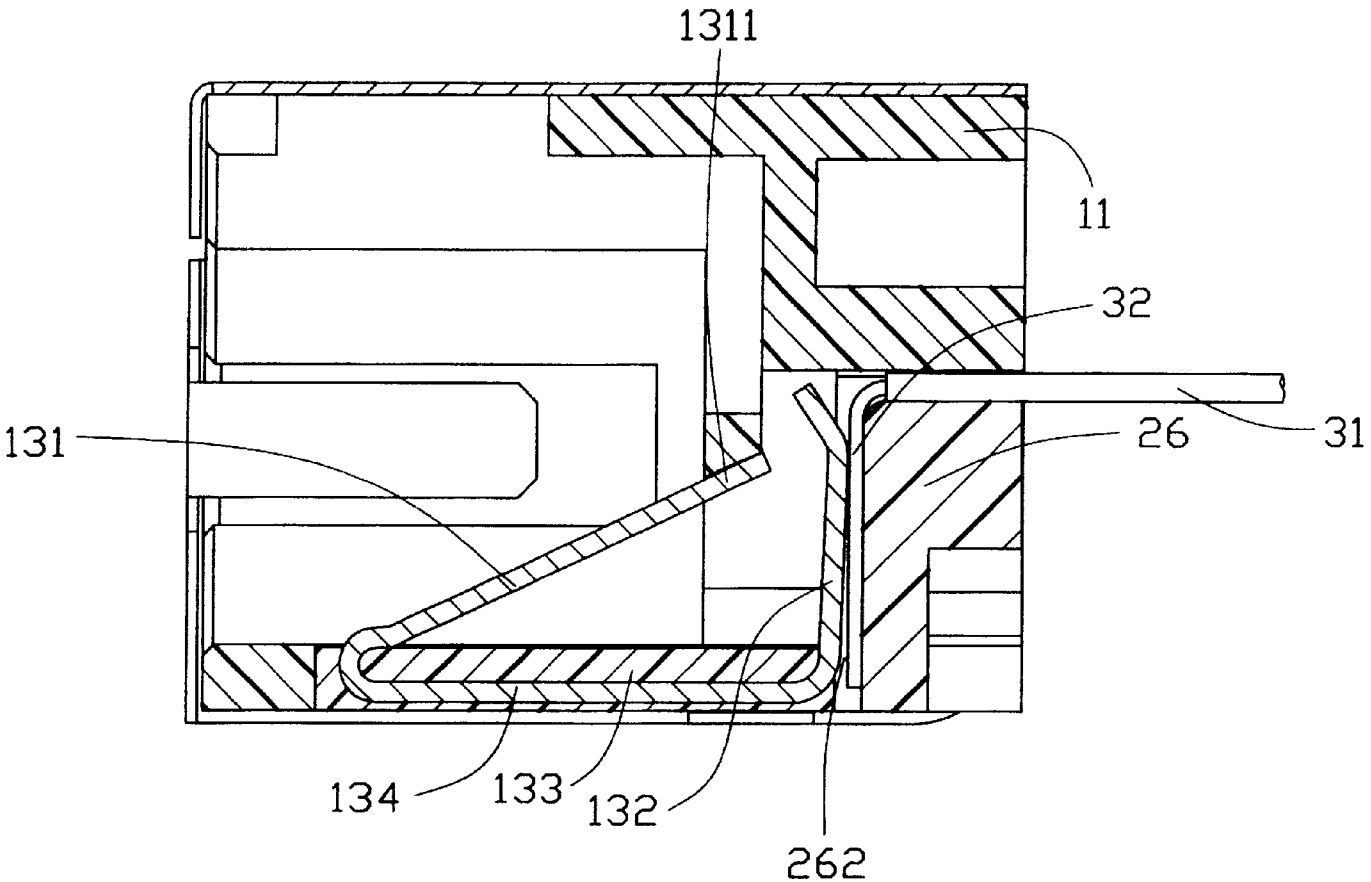
FIG. 7 is similar to FIG. 5, but showing the wire-securing element of FIG. 6 being used to secure a wire of a cable to a connector.

FIG. 6 shows an alternative embodiment of a wire-securing element in accordance with the present invention. A wire-securing element 26 has a base 261 similar to the base 21 of the first wire-securing element 20 of the preferred embodiment. The wire-securing element 26 also has a plurality of arcuate grooves 263 defined in a top face of the base 261, a plurality of receiving grooves 262 defined in a vertical face of the base 261 and in communication with corresponding extremities of the arcuate grooves 263, a pair of arms 264, and a pair of latching ends 265. Referring to FIG. 7, in assembly, each wire 30 is placed in the corresponding arcuate groove 263. The wires 30 are then bent downwardly until the conductors 32 of the wires 30 are embedded in the receiving grooves 262. The wire-securing element 26 is then inserted into the housing 11 in the same way as is the first wire-securing element 20 of the preferred embodiment. The engaging portions 132 of the contacts 130 thereby firmly embed the conductors 32 of the wires 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an electrical connector, including an insulative housing and a plurality of electrical contacts fixed in the housing, each contact comprising a connecting portion, a contact portion extending rearwardly and upwardly from a front end of the connecting portion at an acute angle therefrom, and an engaging portion extending from a rear end of the connecting portion, the housing further defining an receiving opening at a rear of the engaging portions of the contacts;

a wire-securing element inserted into the receiving opening of the housing, the wire-securing element including a base and a plurality of receiving grooves defined in a front portion of the base, the receiving grooves receiving at least parts of the engaging portions of the contacts; and a cable including a plurality of wires, each wire having a conductor therein, each conductor being disposed in a corresponding receiving groove of the wire-securing element and pressed by the engaging portion of the corresponding contact against the base of the wire-securing element, whereby reliable and durable electrical connection between the cable and the connector is attained;

wherein a pair of arms extends from opposite sides of the base, the arms are engaged in a pair of recesses defined in the housing generally at opposite sides of the receiving opening, and the arms are locked by locking tabs formed in the housing rearwardly of the recesses;

wherein a latching end is formed at a bottom portion of each arm of the wire-securing element, the housing further defines a polygonal cutout below each recess, and the latching ends engage in the polygonal cutouts;

wherein a plurality of vertical through holes is defined in the base of the wire-securing element rearwardly of the corresponding receiving grooves, the wires of the cable being respectively received in the through holes;

wherein the wires are inserted into the through holes of the wire-securing element from a lower end thereof such that the wires protrude out beyond upper ends of the through holes;

wherein the contacts are insert molded in a base board, the connecting portions of the contacts are embedded in the base board, and the base board is fixedly connected to the housing;

wherein a stop bar is formed at a front, lower end of the housing, a pair of grooves is defined in the housing rearwardly of the stop bar, a pair of engaging bars is formed on opposite sides of the base board, the base board abuts the stop bar, and the engaging bars are fittingly engaged in the grooves;

wherein a shield formed from a metal sheet encloses the housing of the connector.

* * * * *